US011670223B2

(12) United States Patent
Kim et al.

(10) Patent No.: US 11,670,223 B2
(45) Date of Patent: Jun. 6, 2023

(54) ELECTROLUMINESCENT DISPLAY DEVICE FOR SAMPLING AND SENSING PIXELS

(71) Applicant: LG Display Co., Ltd., Seoul (KR)

(72) Inventors: Min Koo Kim, Seoul (KR); Kyung Rok Kim, Paju-si (KR); Yo Han Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/559,585

(22) Filed: Dec. 22, 2021

(65) Prior Publication Data

US 2022/0208080 A1 Jun. 30, 2022

(30) Foreign Application Priority Data

Dec. 30, 2020 (KR) ..... 10-2020-0187081

(51) Int. Cl.
*G09G 3/32* (2016.01)

(52) U.S. Cl.
CPC ..... *G09G 3/32* (2013.01); *G09G 2310/0294* (2013.01); *G09G 2310/0297* (2013.01)

(58) Field of Classification Search
CPC ..... G09G 3/32
USPC ..... 345/55
See application file for complete search history.

(56) References Cited

U.S. PATENT DOCUMENTS

| | | | | |
|---|---|---|---|---|
| 10,089,928 | B2 | 10/2018 | Yoo et al. | |
| 10,497,308 | B1 * | 12/2019 | Tseng | G09G 3/3233 |
| 2016/0189622 | A1 * | 6/2016 | Lee | G09G 3/3233 345/212 |
| 2018/0033366 | A1 | 2/2018 | Yoo et al. | |
| 2021/0295775 | A1 * | 9/2021 | Lin | G09G 3/3258 |

FOREIGN PATENT DOCUMENTS

| | | | |
|---|---|---|---|
| KR | 10-2015-0078358 | A | 7/2015 |
| KR | 10-2016-0030007 | A | 3/2016 |
| KR | 10-2018-0014389 | A | 2/2018 |

* cited by examiner

*Primary Examiner* — Long D Pham
(74) *Attorney, Agent, or Firm* — Fenwick & West LLP

(57) ABSTRACT

An electroluminescent display device includes a display panel including a plurality of pixels connected to a plurality of sensing lines, a plurality of sampling circuits configured to simultaneously sample driving characteristics of the pixels to generate sampling outputs, a plurality of sampling multiplexers configured to divide the sampling outputs into n groups and to alternately select group sampling outputs, a plurality of scalers individually connected to the sampling multiplexers, and a global multiplexer configured to selectively connect outputs of the scalers to an analog-to-digital conversion circuit, wherein the number of scalers is less than the number of sampling circuits.

17 Claims, 14 Drawing Sheets

<Example of node voltage change in operation periods>

ELECTROLUMINESCENT DISPLAY DEVICE FOR SAMPLING AND SENSING PIXELS

CROSS-REFERENCE TO RELATED APPLICATION

This application claims the benefit of Republic of Korea Patent Application No. 10-2020-0187081, filed on Dec. 30, 2020, which is hereby incorporated by reference in its entirety.

BACKGROUND

Field of Technology

The present disclosure relates to an electroluminescent display device.

Discussion of the Related Art

In active matrix type electroluminescent display devices, pixels each including a light emitting element and a driving element are arranged in a matrix form and the luminance of an image realized by the pixels is controlled according to grayscales of video data. The driving element controls a pixel current flowing through the light emitting element, and the amount of emission of the light emitting element and the luminance of a screen are determined according to the pixel current.

Pixels need to have the same driving characteristics such as the same threshold voltage and electron mobility of driving elements and the same operating point voltage (or turn-on voltage) of light emitting elements, but the driving characteristics may vary due to various causes such as processing and deterioration characteristics. Such driving characteristic differences cause luminance deviation, and thus it is difficult to represent a normal image.

Compensation techniques for sensing and compensating for driving characteristic differences in pixels in order to compensate for luminance deviation in the pixels are known. However, conventional compensation techniques have a problem that scalers connected to all sensing channels cause increase in sensing circuit size and manufacturing cost.

SUMMARY

Accordingly, the present disclosure is directed to an electroluminescent display device that substantially obviates one or more problems due to limitations and disadvantages of the related art.

An object of the present disclosure is to provide an electroluminescent display device capable of reducing a sensing circuit size and manufacturing cost.

To achieve these objects and other advantages and in accordance with the purpose of the invention, as embodied and broadly described herein, an electroluminescent display device includes a display panel including a plurality of pixels connected to a plurality of sensing lines, a plurality of sampling circuits configured to simultaneously sample driving characteristics of the plurality of pixels to generate sampling outputs, a plurality of sampling multiplexers configured to divide the sampling outputs into a plurality of groups of sampling outputs and to alternately select the plurality of groups of sampling outputs, a plurality of scalers, each of the plurality of scalers connected to a corresponding one of the plurality of sampling multiplexers; and a global multiplexer configured to selectively connect outputs of the plurality of scalers to an analog-to-digital conversion circuit, wherein a total number of the plurality of scalers is less than a total number of plurality of sampling circuits.

In one embodiment, an electroluminescent display device comprises: a display panel including a plurality of pixels connected to a plurality of sensing lines; a plurality of sampling circuit groups including a first sampling circuit group comprising a first plurality of sampling circuits that are each connected to a corresponding one of the plurality of sensing lines, and a second sampling circuit group including a second plurality of sampling circuits that are each connected to a corresponding one of the plurality of sensing lines, the plurality of sampling circuit groups configured to sample driving characteristics of the plurality of pixels; a plurality of sampling multiplexers including a first sampling multiplexer and a second sampling multiplexer, the first sampling multiplexer connected to the first sampling circuit group but not the second sampling circuit group, and the second sampling multiplexer connected to the second sampling circuit group but not the first sampling circuit group; a plurality of scalers including a first scaler and a second scaler, the first scaler connected to the first sampling multiplexer but not the second sampling multiplexer, and the second scaler connected to the second sampling multiplexer but not the first sampling multiplexer; a global multiplexer connected to a first output of the first scaler and to a second output of the second scalar, the global multiplexor configured to selectively connect the first output of the first scalar or the second output of the second scalar to an analog-to digital conversion circuit (ADC), wherein while the first output of the first scalar is connected to the ADC through the global multiplexor, the second output of the second scalar is not connected to the ADC and the second input of the second scalar is connected to the second sampling circuit group through the second sampling multiplexor, and while the second output of the second scalar is connected to the ADC through the global multiplexor, the first output of the first scalar is not connected to the ADC and the first input of the first scalar is connected to the first sampling circuit group through the first sampling multiplexor.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
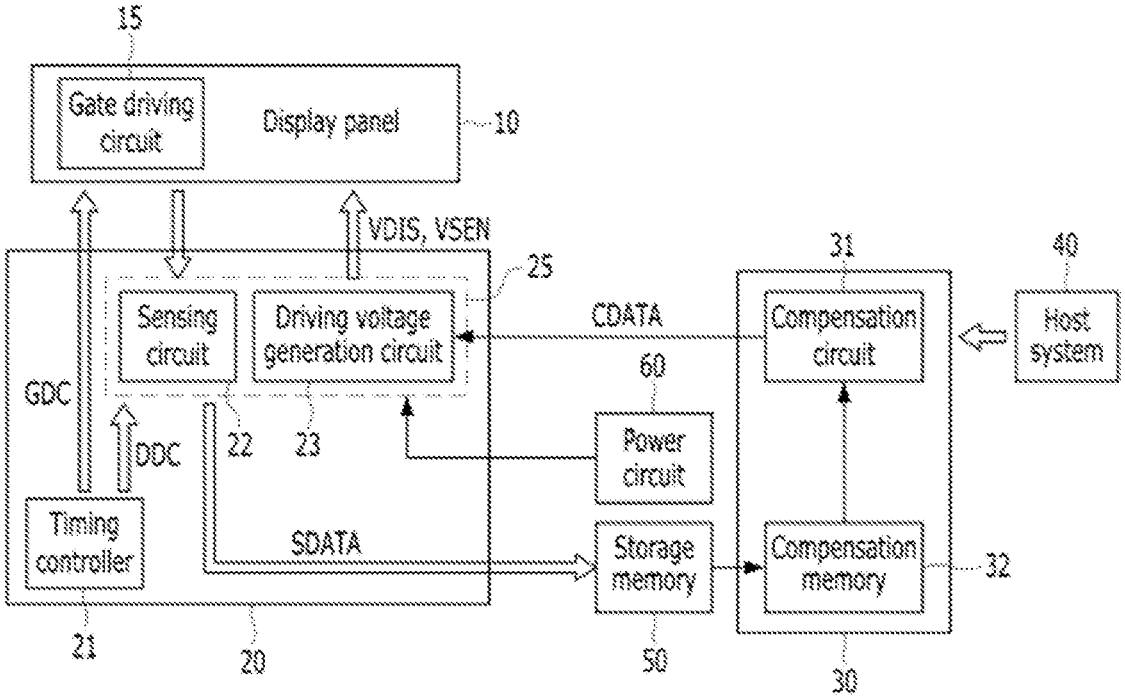
FIG. 1 is a diagram showing an electroluminescent display device according to an embodiment of the present disclosure.

The advantages and features of the present disclosure and the way of attaining the same will become apparent with reference to embodiments described below in detail in conjunction with the accompanying drawings. The present disclosure, however, is not limited to the embodiments disclosed hereinafter and may be embodied in many different forms. Rather, these exemplary embodiments are provided so that this disclosure will be through and complete and will fully convey the scope to those skilled in the art. Thus, the scope of the present disclosure should be defined by the claims.

The shapes, sizes, ratios, angles, numbers, and the like, which are illustrated in the drawings in order to describe various embodiments of the present disclosure, are merely given by way of example, and therefore, the present disclosure is not limited to the illustrations in the drawings. The same or extremely similar elements are designated by the same reference numerals throughout the specification. In addition, in the description of the present disclosure, a detailed description of related known technologies will be omitted when it may make the subject matter of the present disclosure rather unclear. In the present specification, when the terms "comprise", "include", and the like are used, other elements may be added unless the term "only" is used. An element described in the singular form is intended to include a plurality of elements unless the context clearly indicates otherwise.

In the interpretation of constituent elements included in the various embodiments of the present disclosure, the constituent elements are interpreted as including an error range even if there is no explicit description thereof.

In the description of the various embodiments of the present disclosure, when describing positional relationships, for example, when the positional relationship between two parts is described using "on", "above", "below", "beside", or the like, one or more other parts may be located between the two parts unless the term "directly" or "closely" is used.

Although terms such as, for example, "first" and "second" may be used to describe various elements, these terms are merely used to distinguish the same or similar elements from each other. Therefore, in the present specification, an element modified by "first" may be the same as an element modified by "second" within the technical scope of the present disclosure unless otherwise mentioned.

In the present disclosure, a pixel circuit formed on a substrate of a display panel may be implemented as a thin film transistor (TFT) in an n-type metal oxide semiconductor field effect transistor (MOSFET) structure or a TFT in a p-type MOSFET structure. A TFT is a 3-electrode element including a gate, a source, and a drain. The source is an electrode that supplies carriers to the transistor. Carriers flow from the source in the TFT. The drain is an electrode through which carriers are discharged to the outside. That is, carriers flow from the source to the drain in a MOSFET. In the case of an n-type TFT (NMOS), carriers are electrons and thus a source voltage is lower than a drain voltage such that electrons can flow from the source to the drain. Since electrons flow from the source to the drain in the n-type TFT, current flows from the drain to the source. On the contrary, in the case of a p-type TFT (PMOS), carriers are holes and thus a source voltage is higher than a drain voltage such that holes can flow from the source to the drain. Since holes flow from the source to the drain in the p-type TFT, current flows from the source to the drain. It should be noted that the source and the drain of a MOSFET are not fixed. For example, the source and the drain of a MOSFET may be changed according to an applied voltage.

In the present disclosure, a semiconductor layer of a TFT may be formed of at least one of oxide, amorphous silicon, and polysilicon.

Hereinafter, embodiments of the present disclosure will be described in detail with reference to the attached drawings. In the following description, a detailed description of known functions and configurations incorporated herein will be omitted when it may obscure the subject matter of the present invention.

Figure 2:
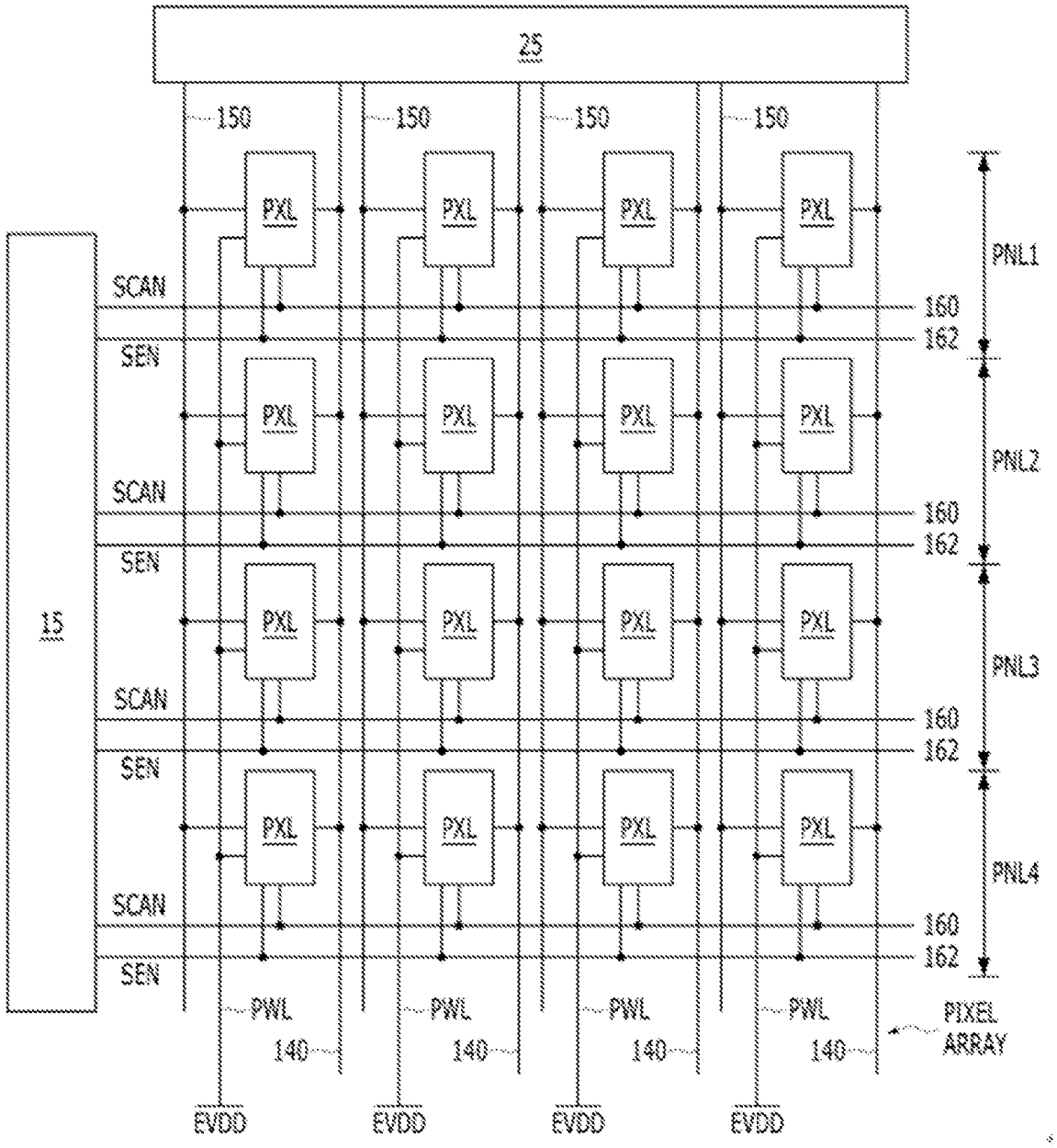
FIG. 2 is a diagram showing an example of a pixel array included in a display panel of FIG. 1 according to an embodiment of the present disclosure.

FIG. 1 is a diagram showing an electroluminescent display device according to an embodiment of the present disclosure and FIG. 2 is a diagram showing an example of a pixel array included in a display panel of FIG. 1;

Referring to FIG. 1 and FIG. 2, the electroluminescent display device according to an embodiment of the present disclosure may include a display panel 10, a driver integrated circuit 20, a compensation integrated circuit 30, a host system 40, a storage memory 50, and a power circuit 60. A panel driving circuit for driving the display panel 10 includes a gate driving circuit 15 included in the display panel 10 and a data driving circuit 25 embedded in the driver integrated circuit 20.

The display panel 10 includes a plurality of pixels lines PNL1 to PNL4 and each pixel line includes a plurality of pixels PXL and a plurality of signal lines. A "pixel line" described in the present disclosure is not a physical signal line and means a set of pixels PXL and signal lines adjacently disposed in a horizontal direction (e.g., a pixel row). The signal lines may include data lines 140 for supplying a data voltage VDIS for display and a data voltage VSEN for sensing to the pixels PXL, sensing lines 150 for supplying an initialization voltage to the pixels PXL and then sensing driving characteristics of the pixels PXL, gate line pairs 160 and 162 for supplying gate signals SCAN and SEN to the pixels PXL, and high-level power lines PWL for supplying a high-level pixel voltage to the pixels PXL.

The pixels PXL of the display panel 10 are arranged in a matrix form to constitute a pixel array. Each pixel included in the pixel array in FIG. 2 may be connected to one of the data lines 140, one of the sensing lines 150, one of the high-level power lines PWL, and one of the gate line pairs 160 and 162. Each pixel included in the pixel array in FIG. 2 may receive a low-level pixel voltage from the power circuit 60. The power circuit 60 may supply the low-level pixel voltage to each pixel PXL through a low-level power line or a pad.

The gate driving circuit 15 may be embedded in the display panel 10. The gate driving circuit 15 may be positioned in a non-display area outside a display area in which the pixel array is formed.

The gate driving circuit 15 may include a plurality of gate stages connected to the gate line pairs 160 and 162 of the pixel array. The gate stages may generate a first gate signal SCAN for controlling switch elements of the pixels PXL, supply the first gate signal SCAN to the first gate lines 160, generate a second gate signal SEN for controlling the switch elements of the pixels PXL and supply the second gate signal SEN to the second gate lines 162.

The driver integrated circuit 20 may include a timing controller 21 and the data driving circuit 25, but the present disclosure is not limited thereto. The timing controller 21 may be mounted on a control board along with the driver integrated circuit 20 instead of being included in the driver integrated circuit 20. The data driving circuit 25 may include a sensing circuit 22 and a driving voltage generation circuit 23, but the present disclosure is not limited thereto.

The timing controller 21 may generate a gate timing control signal GDC for controlling operation timing of the gate driving circuit 15 and a data timing control signal DDC for controlling operation timing of the data driving circuit 25 on the basis of timing signals input from the host system 40, for example, a vertical synchronization signal Vsync, a horizontal synchronization signal Hsync, a dot clock signal DCLK, and a data enable signal DE.

The data timing control signal DDC may include a source start pulse signal, a source sampling clock signal, and a source output enable signal, but the present disclosure is not limited thereto. The source start pulse signal controls data sampling start timing of the driving voltage generation circuit 23. The source sampling clock signal controls data sampling timing based on a rising or falling edge. The source output enable signal controls output timing of the driving voltage generation circuit 23.

The gate timing control signal GDC may include a gate start pulse signal and a gate shift clock signal, but the present disclosure is not limited thereto. The gate start pulse signal is applied to a gate stage that generates a first gate output to enable operation of the gate stage. The gate shift clock signal is commonly input to the gate stages and shifts the gate start pulse signal.

The timing controller 21 may sense driving characteristics of the pixels PXL in a vertical blank period of each frame by controlling operation timing of the panel driving circuit. Further, the timing controller 21 may additionally sense voltage sustainability of sensing lines before detecting the driving characteristics of the pixels PXL in at least one of a plurality of vertical blank periods by controlling operation timing of the panel driving circuit. The timing controller 21 may further sense the driving characteristics of the pixels PXL in a power on period or a power off period by controlling operation timing of the panel driving circuit.

Here, the power on period is a period from when system power is applied to when the display panel 10 is turned on and the power off period is a period from when the display panel 10 is turned off to when system power is off. A vertical blank period is provided between neighboring vertical active periods and is a period in which writing of video data stops. A vertical active period is a period in which video data is written in the display panel 10 in order to display an image. The driving characteristics of the pixels PXL may include at least one of a threshold voltage and electron mobility of driving elements included in the pixels PXL, and an operating point voltage of light emitting elements. Sensing lines may be the reference voltage lines 150.

The timing controller 21 may realize a display operation and a sensing operation by controlling sensing operation timing and display operation timing of the pixel lines PNL1 to PNL4 of the display panel 10 according to a predetermined sequence.

The timing controller 21 may generate timing control signals GDC and DDC for display operation and timing control signals GDC and DDC for sensing operation such that they are different from each other. The sensing operation means a pixel sensing operation. The pixel sensing operation is an operation of writing a data voltage VSEN for sensing in sensing target pixels PXL to sense driving characteristics of the pixels PXL and updating a compensation value for compensating for change in the driving characteristics of the pixels PXL on the basis of sensing result data SDATA. The display operation is an operation of correcting digital video data to be input to the corresponding pixels PXL on the basis of the updated compensation value and applying a data voltage VDIS for display corresponding to the corrected video data CDATA to the pixels PXL to display an input image.

The driving voltage generation circuit 23 may be implemented as a digital-to-analog converter (DAC) that converts a digital signal into an analog signal. The driving voltage generation circuit 23 may be connected to the pixels PXL through the data lines 140. The driving voltage generation circuit 23 generates the data voltage VSEN for sensing that is necessary for the pixel sensing operation and the data voltage VDIS for display that is necessary for the display operation and supplies the data voltage VSEN for sensing and the data voltage VDIS for display to the data lines 140. The data voltage VDIS for display is a digital-to-analog conversion result for the digital video data CDATA corrected in the compensation integrated circuit 30 and may vary according to a grayscale value and a compensation value in pixel units. The data voltage VSEN for sensing may be set differently in red, green, blue, and white pixels in consideration of different driving characteristics of driving elements for colors.

The sensing circuit 22 may be connected to the pixels PXL through the sensing lines 150. The sensing circuit 22 may supply an initialization voltage VPRES that is necessary for the pixel sensing operation to the sensing lines 150 and then senses specific node voltages of pixels PXL which represent driving characteristics of the pixels PXL through the sensing lines 150.

The sensing circuit 22 sequentially converts analog sampling outputs generated by a plurality of sampling circuits into digital data using an analog-to-digital converter (ADC). Scalers and multiplexers are connected between the plurality of sampling circuits and the ADC. The scalers scale analog sampling outputs such that the analog sampling outputs are adapted for an operation range of the ADC. The multiplexers selectively provide outputs of the scalers to the ADC. The ADC converts the analog sampling outputs into digital sensing result data SDATA according to the operation range and then provides the digital sensing result data SDATA to the storage memory 50.

The scalers occupy a relatively large area in the sensing circuit 22 because they include large-capacity scaling capacitors. To reduce the size and manufacturing cost of the sensing circuit 22, a MUX1-scaler-MUX2 connection structure may be adopted for the sensing circuit 22. The number of scalers can be reduced to be less than the number of sampling circuits in the sensing circuit 22 through the MUX1-scaler-MUX2 connection structure. MUX1 includes sampling multiplexers for multiplexing sampling circuits and MUX2 includes a global multiplexer for multiplexing scalers. Since the number of scalers equals the number of MUX1s, the number of scalers is reduced to be less than the number of sampling circuits.

The storage memory 50 stores the digital sensing result data SDATA received from the sensing circuit 22 during sensing operation. The storage memory 50 may be implemented as a flash memory, but the present disclosure is not limited thereto.

The compensation integrated circuit 30 may include a compensation circuit 31 and a compensation memory 32. The compensation memory 32 transmits the digital sensing result data SDATA read from the storage memory 50 to the compensation circuit 31. The compensation memory 32 may be a random access memory (RAM), for example, double data rate synchronous dynamic RAM (DDR SDRAM), but the present disclosure is not limited thereto. The compensation circuit 31 calculates a compensation offset and a compensation gain for each pixel on the basis of the digital sensing result data SDATA read from the storage memory 50, corrects video data received from the host system 40 according to the calculated compensation offset and compensation gain, and provides the corrected video data CDATA to the driver integrated circuit 20.

The power circuit 60 may generate the high-level pixel voltage and the low-level pixel voltage to be supplied to the pixels PXL. In addition, the power circuit 60 may generate the initialization voltage VPRES and reference voltages (EVREF1 and EVREF2 in FIG. 6) to be supplied to the sensing circuit 22. The first and second reference voltages (EVREF1 and EVREF2 in FIG. 6) may be set to different levels for sensing and sensing discrimination improvement. For example, the first reference voltage EVREF1 may be set to be higher than the second reference voltage EVREF2, as shown in FIG. 7.

Figure 3:
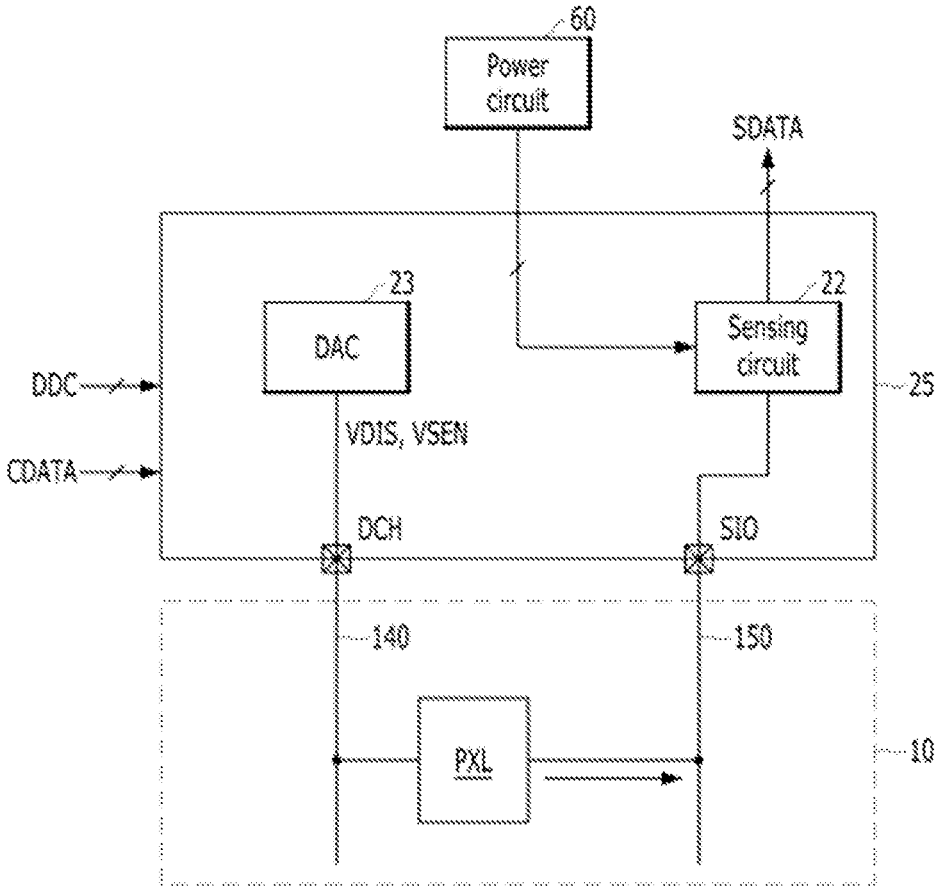
FIG. 3 is a diagram showing a configuration of a data driver connected to the pixel array of FIG. 2 according to an embodiment of the present disclosure.

FIG. 3 is a diagram illustrating a configuration of the data driving circuit 25 connected to the pixel array of FIG. 2 according to one embodiment.

Referring to FIG. 3, the data driving circuit 25 may be connected to a first node (connected to a gate electrode of a driving element) of a pixel PXL through the data line 140 and connected to a second node (connected to a source electrode of the driving element) of the pixel PXL through the sensing line 150. A voltage set to the second node may vary according to driving characteristics of the pixel PXL.

The data driving circuit 25 may include the driving voltage generation circuit (DAC) 23 and the sensing circuit 22. The DAC 23 is connected to the data line 140 of the display panel 10 through a data channel DCH and the sensing circuit 22 is connected to the sensing line 150 of the display panel 10 through a sensing channel SIO. The DAC 23 generates the data voltage VSEN for sensing and the data voltage VDIS for display.

During pixel sensing operation, the sensing channel SIO provides a path through which the initialization voltage VPRES is charged in the sensing line 150 and then provides a path through which a second node voltage of the pixel PXL is sensed through the sensing circuit 22.

Figure 4:
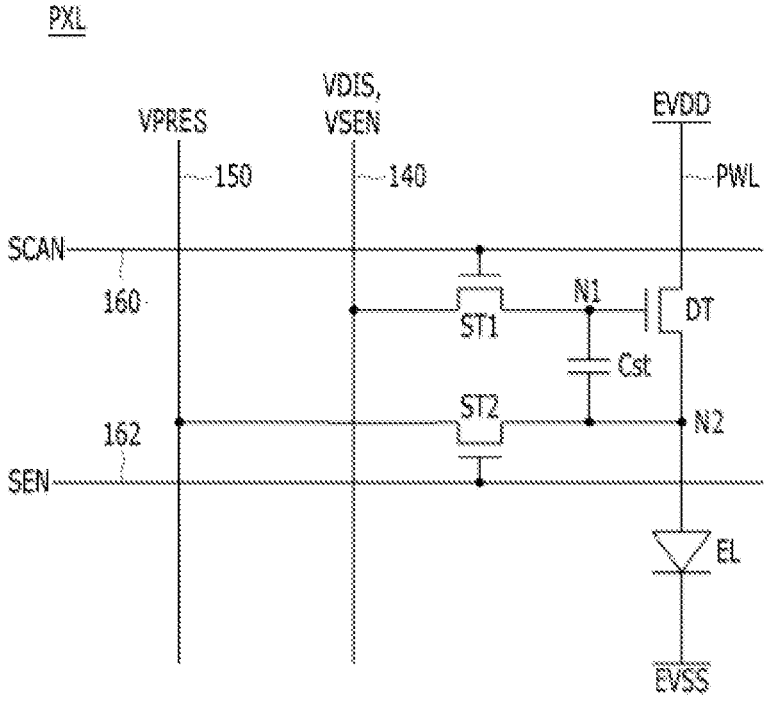
FIG. 4 is an equivalent circuit diagram of a pixel illustrated in FIG. 3 according to an embodiment of the present disclosure.

FIG. 4 is an equivalent circuit diagram of the pixel shown in FIG. 3 according to one embodiment. It is noted that the technical spirit of the present disclosure is not limited to the pixel structure of FIG. 4.

Referring to FIG. 4, one pixel PXL includes a light emitting element EL, a driving TFT DT, switch TFTs ST1 and ST2, and a storage capacitor Cst. The driving TFT DT and the switch TFTs ST1 and ST2 may be implemented as NMOSs, but the present disclosure is not limited thereto.

The light emitting element EL emits light according to a pixel current supplied from the driving TFT DT. The light emitting element EL may be implemented as an organic light emitting diode including an organic emission layer or an inorganic light emitting diode including an inorganic emission layer. An anode of the light emitting element EL is connected to a second node N2 and a cathode thereof is connected to an input terminal for receiving a low-level pixel voltage EVSS.

The driving TFT DT is a driving element that generates a pixel current in response to a gate-source voltage. The gate electrode of the driving TFT DT is connected to a first node N1, a first electrode thereof is connected to an input terminal for receiving a high-level pixel voltage EVDD through the high-level power line PWL, and the second electrode thereof is connected to the second node N2.

The switch TFTs ST1 and ST2 are switch elements that set the gate-source voltage of the driving TFT DT and connect the first electrode of the driving TFT DT to the data line 140 or connect the second electrode of the driving TFT DT to the sensing line 150.

The first switch TFT ST1 is connected between the data line 140 and the first node N1 and is turned on according to the first gate signal SCAN from the first gate line 160. The first switch TFT ST1 is turned on at the time of programming for display operation or pixel sensing operation. When the first switch TFT ST1 is turned on, the data voltage VDIS for display or the data voltage VSEN for sensing is applied to the first node N1. The gate electrode of the first switch TFT ST1 is connected to the first gate line 160, the first electrode thereof is connected to the data line 140, and the second electrode thereof is connected to the first node N1.

The second switch TFT ST2 is connected between the sensing line 150 and the second node N2 and is turned on according to the second gate signal SEN from the second gate line 162. The second switch TFT ST2 is turned on at the time of programming for display operation or pixel sensing operation to apply the initialization voltage VPRES to the second node N2. The second switch TFT ST2 is turned on in a sensing period for pixel sensing operation to connect the second node N2 to the sensing line 150 such that the voltage of the second node N2 in which driving characteristics of the driving TFT DT or the light emitting element EL have been reflected is charged in the sensing line 150. The gate electrode of the second switch TFT ST2 is connected to the gate line 160, the first electrode thereof is connected to the sensing line 150, and the second electrode thereof is connected to the second node N2.

The storage capacitor Cst is connected between the first node N1 and the second node N2 and maintains the gate-source voltage of the driving TFT DT for a predetermined period.

The pixel PXL having the aforementioned configuration displays an image according to a first pixel current based on a difference between the data voltage VDIS for display and the initialization voltage VPRER during display operation and charges the second node N2 and the sensing line 150 according to a second pixel current based on a difference between the data voltage VSEN for sensing and the initialization voltage VPRES at the time of pixel sensing operation.

Figure 5:
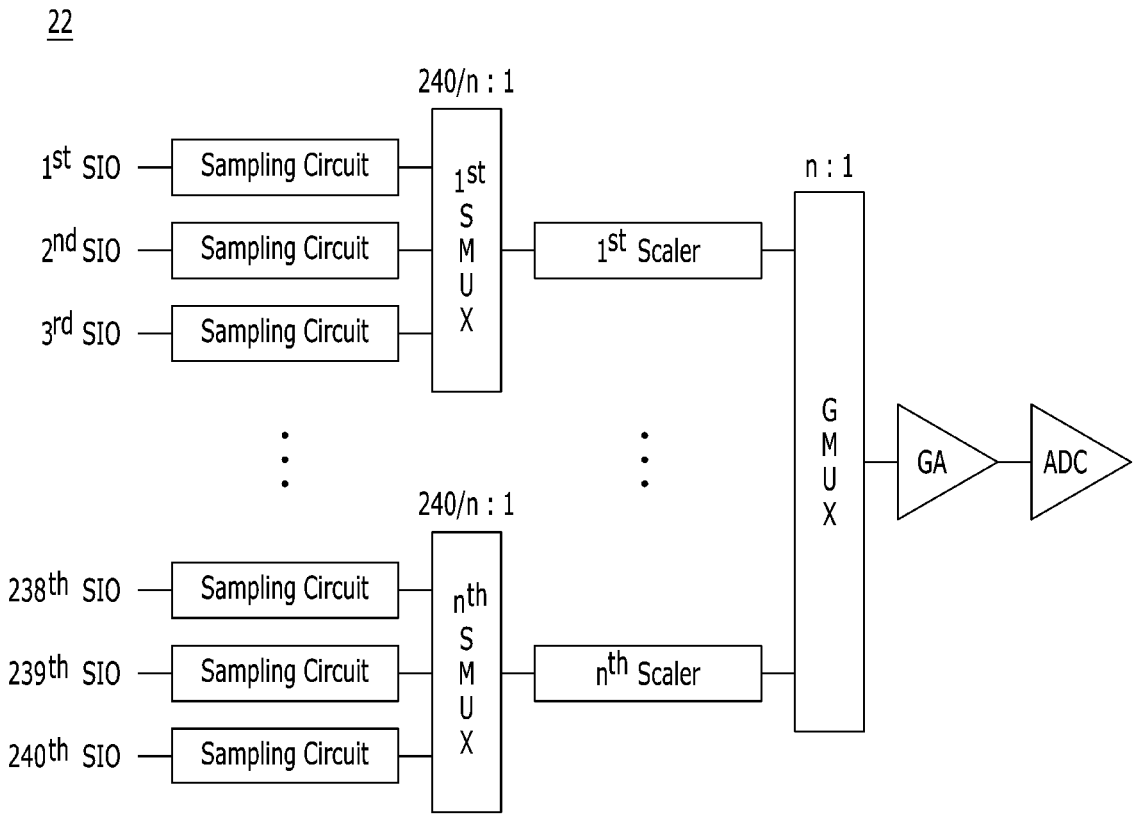
FIG. 5 is a diagram schematically showing connection of a sensing circuit according to an embodiment of the present disclosure.

FIG. 5 is a diagram schematically showing connection of the sensing circuit according to an embodiment of the present disclosure.

Referring to FIG. 5, the sensing circuit 22 may include sampling circuits, sampling multiplexers SMUX, scalers, a global multiplexer GMUX, a global amplifier GA, and an ADC. Since the scalers are connected between the sampling multiplexers SMUX and the global multiplexer GMUX, the aforementioned MUX1-scaler-MUX2 connection structure can be realized and the number of scalers can be reduced to be less than the number of sampling circuits.

m (m being a natural number) sampling circuits may be one-to-one connected to m sensing channels SIO. The m sampling circuits simultaneously sample driving characteristics of pixels through the sensing channels SIO to generate m sampling outputs. For example, m may be 240. Each sampling circuit may sample a corresponding one of the pixels through a corresponding one of the sensing channels SIO.

n (n being a natural number equal to or greater than 2 and less than m) sampling multiplexers SMUX divide the m sampling outputs into n groups. The first to n-th sampling multiplexers SMUX respectively select first to n-th group sampling outputs. Here, a single group sampling output includes a plurality of sampling outputs.

n scalers are one-to-one connected to the n sampling multiplexers SMUX.

The first to n-th sampling multiplexers SMUX alternately select the first to n-th group sampling outputs and provide selected sampling outputs to the n scalers. For example, the first sampling multiplexer selects one of sampling outputs in the first group sampling output and provides the selected sampling output to the first scaler, and then the second sampling multiplexer selects one of sampling outputs in the second group sampling output and provides the selected sampling output to the second scaler. Then, the n-th sampling multiplexer selects one of sampling outputs in the n-th group sampling output and provides the selected sampling output to the n-th scaler. In this manner, the m sampling outputs are scaled through the n scalers sequentially and alternately.

The global multiplexer GMUX selectively connects the n scalers to the ADC. The global amplifier GA may be connected between the global multiplexer GMUX and the ADC. The global amplifier GA additionally processes a scaler output selectively input thereto through the global multiplexer GMUX such that the scaler output is adapted for input conditions of the ADC.

To secure sufficient scaling time for each scaler, sampling outputs of groups (the second to n-th groups) other than the first group may be scaled in the second to n-th scalers while the sampling output of the first group is toggled to the ADC in the first scaler. In other words, while the first scaler is connected to the ADC, the remaining scalers other than the first scaler may be connected to sampling circuits through the sampling multiplexers SMUX.

Figure 6:
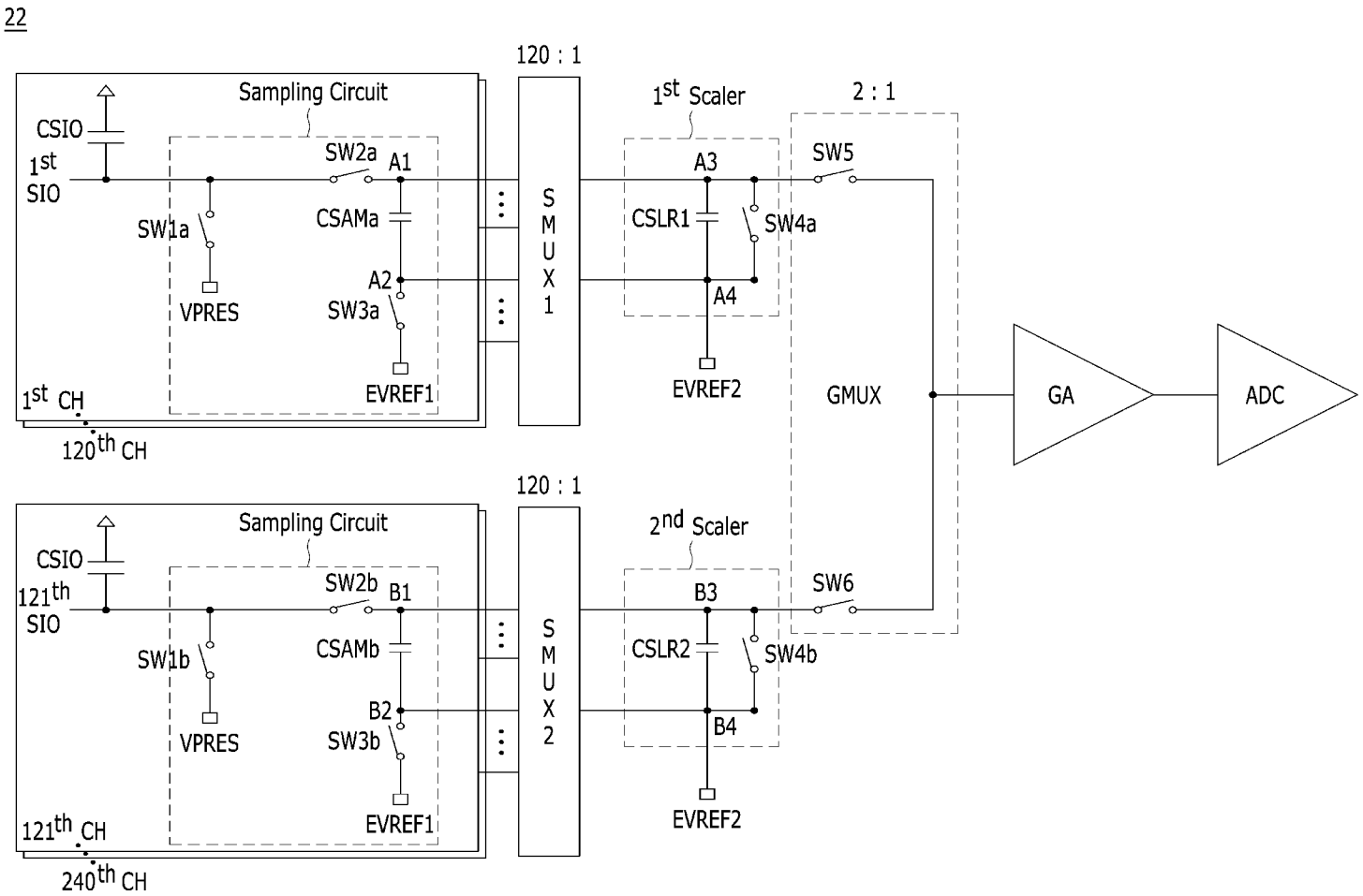
FIG. 6 is a diagram showing a first embodiment of the sensing circuit.
Figure 7:
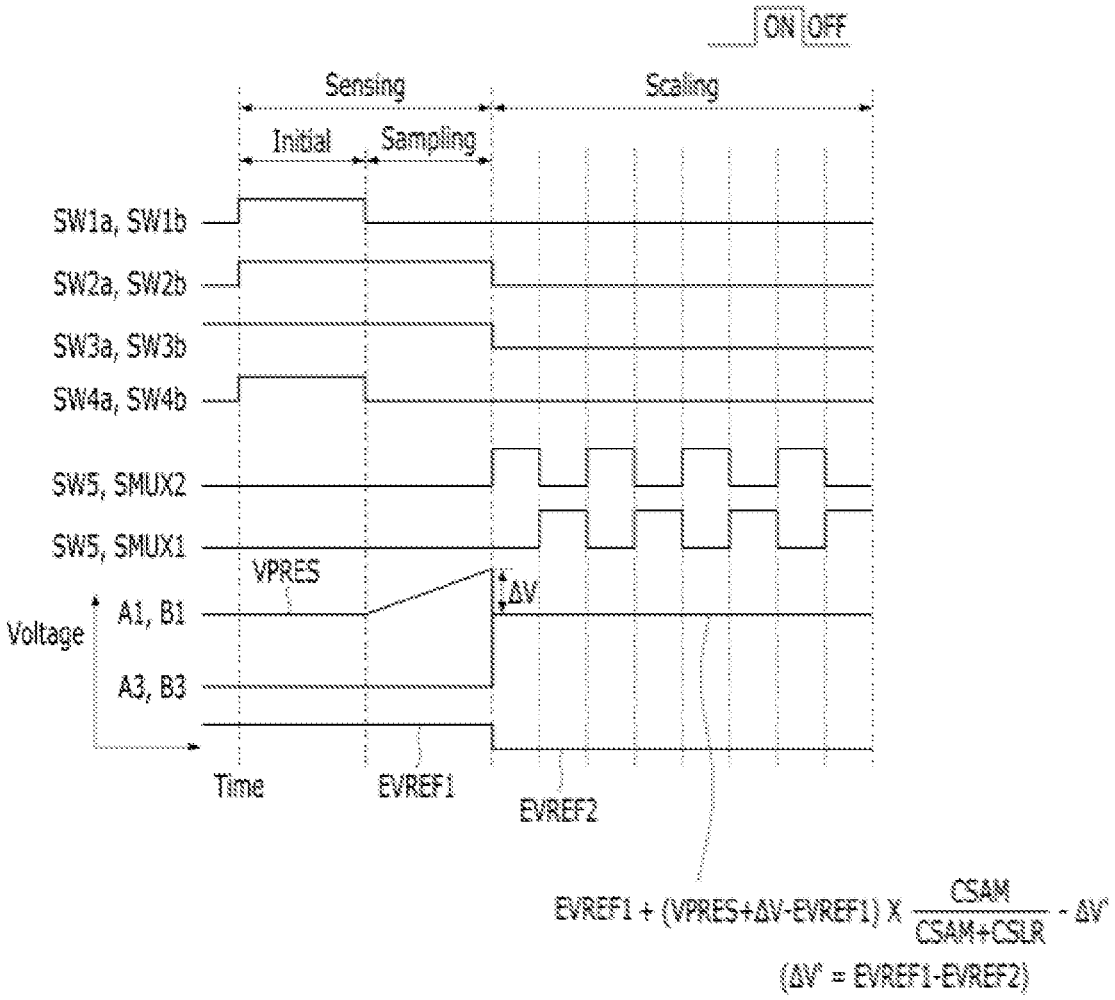
FIG. 7 shows operation waveforms for the sensing circuit of FIG. 6 according to the first embodiment of the present disclosure.

FIG. 6 is a diagram showing a first embodiment of the sensing circuit 22 and FIG. 7 shows operation waveforms for the sensing circuit 22 of FIG. 6 according to the first embodiment.

Referring to FIG. 6 and FIG. 7, the sensing circuit 22 includes first to $120^{th}$ sampling circuits connected to first to $120^{th}$ sensing channels SIO, a first sampling multiplexer SMUX1 for selectively connecting first to $120^{th}$ sampling outputs corresponding to the first to $120^{th}$ sampling circuits to a first scaler, $121^{th}$ to $240^{th}$ sampling circuits connected to $121^{th}$ to $240^{th}$ sensing channels SIO, a second sampling multiplexer SMUX2 for selectively connecting $121^{th}$ to $240^{th}$ sampling outputs corresponding to the $121^{th}$ to $240^{th}$ sampling circuits to a second scaler, and a global multiplexer GMUX for selectively connecting outputs of the first and second scalers to an ADC.

The first sampling multiplexer SMUX1 and the second sampling multiplexer SMUX2 have an input-to-output ratio of 120:1. The global multiplexer GMUX has an input-to-output ratio of 2:1.

Each of the first to $120^{th}$ sampling circuits includes a first switch SW1*a*, a second switch SW2*a*, a third switch SW3*a*, and a sampling capacitor CSAMa. The first switch SW1*a* supplies the initialization voltage VPRES to a sensing line for an initialization time. The second switch SW2*a* applies a voltage of the sensing line in which driving characteristics of pixels have been reflected (i.e., a voltage stored in CSIO) to a first node A1 for a sampling time following the initialization time. The third switch SW3*a* applies the first reference voltage EVREF1 to a second node A2 for the sampling time. One electrode of the sampling capacitor CSAMa is connected to the first node A1 and the other electrode thereof is connected to the second node A2. A sampling output that is the voltage of one electrode of the sampling capacitor CSAMa increases from the initialization voltage VPRES for the sampling time.

Each of the $121^{th}$ to $240^{th}$ sampling circuits includes a first switch SW1*b*, a second switch SW2*b*, a third switch SW3*b*, and a sampling capacitor CSAMb. The first switch SW1*b* supplies the initialization voltage VPRES to a sensing line for the initialization time. The second switch SW2*b* applies a voltage of the sensing line in which driving characteristics of pixels have been reflected (i.e., a voltage stored in CSIO) to a first node B1 for the sampling time following the initialization time. The third switch SW3*b* applies the first reference voltage EVREF1 to a second node B2 for the sampling time. One electrode of the sampling capacitor CSAMb is connected to the first node B1 and the other electrode thereof is connected to the second node B2. A sampling output that is the voltage of one electrode of the sampling capacitor CSAMb increases from the initialization voltage VPRES for the sampling time.

Sampling outputs are simultaneously generated in the first to $240^{th}$ sampling circuits.

The first scaler includes a scaling capacitor CSLR1 connected to a third node A3 and a fourth node A4, and a fourth switch SW4*a* connected to the third node A3 and the fourth node A4. For a scaling time following the sampling time, the third node A3 is connected to the first node A1 through the first sampling multiplexer SMUX1, the fourth node A4 is connected to the second node A2 through the first sampling multiplexer SMUX1, and the second reference voltage EVREF2 is applied to the second node A2 and the fourth node A4.

The second scaler includes a scaling capacitor CSLR2 connected to a third node B3 and a fourth node B4, and a fourth switch SW4*b* connected to the third node B3 and the fourth node B4. For the scaling time following the sampling time, the third node B3 is connected to the first node B1 through the second sampling multiplexer SMUX2, the fourth node B4 is connected to the second node B2 through the second sampling multiplexer SMUX2, and the second reference voltage EVREF2 is applied to the second node B2 and the fourth node B4.

Scaling rates in the first scaler and the second scaler for the scaling time are determined by the proportion of sampling capacitors CSAM to scaling capacitors CSLR. Voltages of the first and third nodes A1 and A3 or B1 and B3 become scaling outputs for the scaling time. A scaling output may be "EVREF1+(VPRES+ΔV−EVREF1)*{CSAM/(CSAM+CSLR)}−ΔV'". Here, ΔV' is EVREF1−EVREF2. Here, EVREF1 may be higher than EVREF2.

The global multiplexer GMUX includes a fifth switch SW5 for connecting the first scaler to the ADC and a sixth switch SW6 for connecting the second scaler to the ADC. The fifth switch SW5 and the sixth switch SW6 are alternately turned on.

The first sampling multiplexer SMUX1 and the second sampling multiplexer SMUX2 are turned on/off in opposite phases. The first sampling multiplexer SMUX1 is turned off and the second sampling multiplexer SMUX2 is turned on while the fifth switch SW5 is turned on. The second sampling multiplexer SMUX2 is turned off and the first sampling multiplexer SMUX1 is turned on while the sixth switch SW6 is turned on.

In other words, the second sampling multiplexer SMUX2 is turned on and the second scaler performs scaling operation while the first scaling output is toggled to the ADC through the fifth switch SW5. Subsequently, the first sampling multiplexer SMUX1 is turned on and the first scaler performs scaling operation while the second scaling output is toggled to the ADC through the sixth switch SW6.

In this manner, the two scalers respectively perform scaling operation and toggling operation at the same time while changing the scaling operation and the toggling operation at predetermined intervals in a ping-pong manner in the sensing circuit 22 according to the first embodiment.

Figure 8:
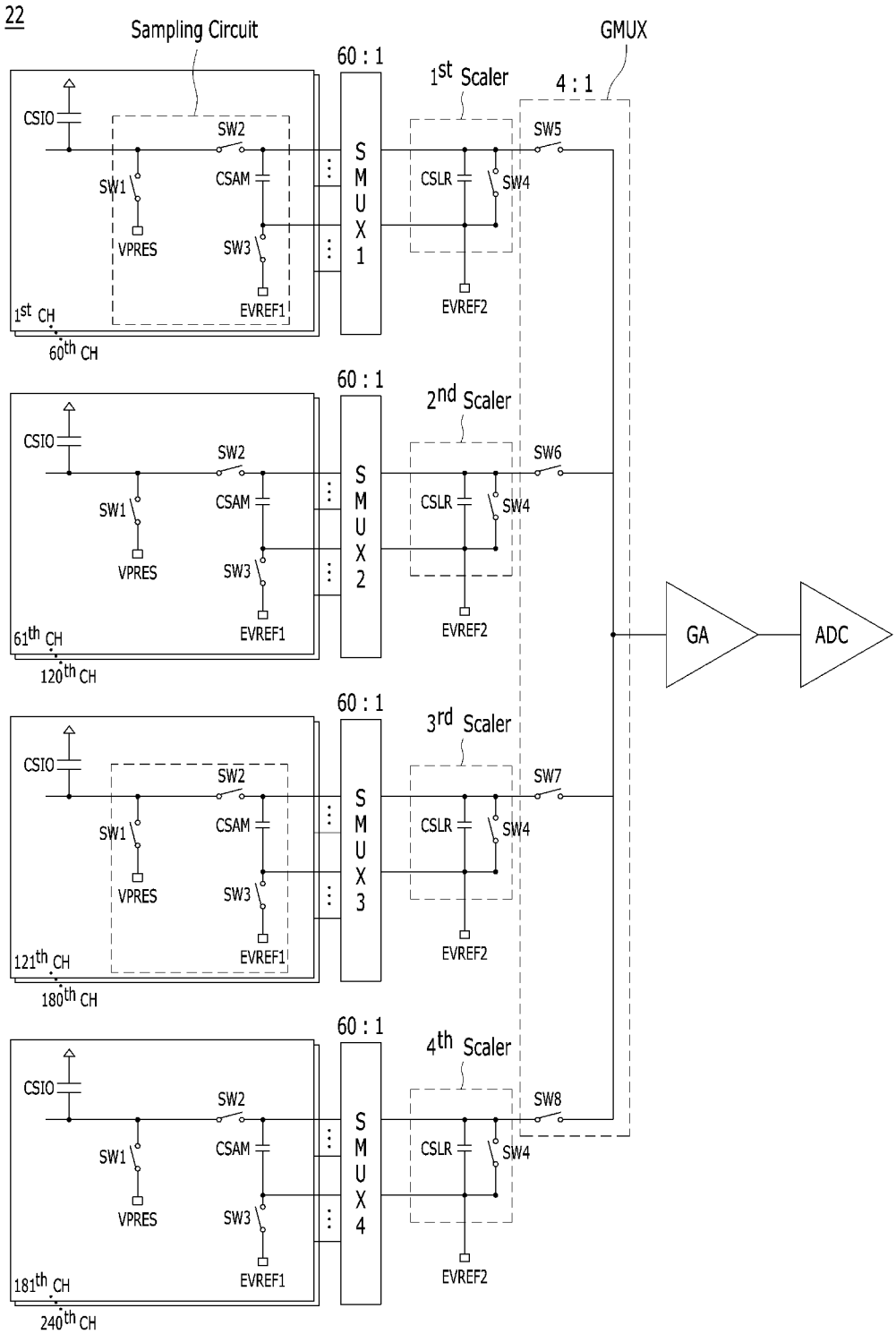
FIG. 8 is a diagram showing a second embodiment of the sensing circuit.
Figure 9:
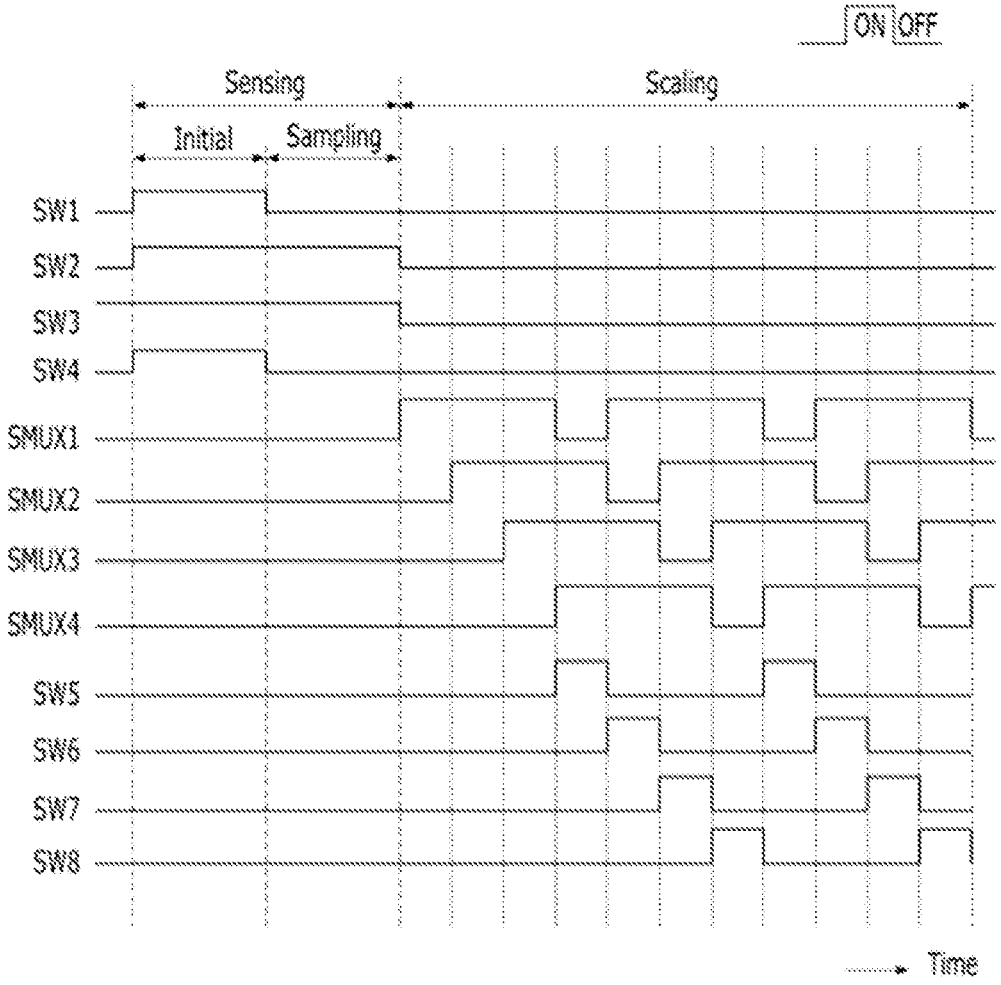
FIG. 9 is a diagram showing operation waveforms for the sensing circuit of FIG. 8 according to the second embodiment of the present disclosure.

FIG. 8 is a diagram showing a second embodiment of the sensing circuit 22 and FIG. 9 is a diagram showing operation waveforms for the sensing circuit 22 of FIG. 8 according to the second embodiment.

Referring to FIG. 8 and FIG. 9, the sensing circuit 22 includes first to $60^{th}$ sampling circuits connected to first to $60^{th}$ sensing channels SIO, a first sampling multiplexer SMUX1 for selectively connecting first to $60^{th}$ sampling circuits to a first scaler, $61^{st}$ to $120^{th}$ sampling circuits connected to $61^{st}$ to $120^{th}$ sensing channels SIO, a second sampling multiplexer SMUX2 for selectively connecting $61^{st}$ to $120^{th}$ sampling circuits to a second scaler, $121^{st}$ to $180^{th}$ sampling circuits connected to $121^{st}$ to $180^{th}$ sensing channels SIO, a third sampling multiplexer SMUX3 for selectively connecting the $121^{st}$ to $180^{th}$ sampling circuits to a third scaler, $181^{st}$ to $240^{th}$ sampling circuits connected to $181^{st}$ to $240^{th}$ sensing channels SIO, a fourth sampling multiplexer SMUX4 for selectively connecting $181^{st}$ to $240^{th}$ sampling circuits to a fourth scaler, and a global multiplexer GMUX for selectively connecting outputs of the first to fourth scalers to an ADC.

The first to fourth sampling multiplexers SMUX1 to SMUX4 have an input-to-output ratio of 60:1. The global multiplexer GMUX has an input-to-output ratio of 4:1.

Each sampling circuit includes a first switch SW1, a second switch SW2, a third switch SW3, and a sampling capacitor CSAM. The first switch SW1 supplies the initialization voltage VPRES to a sensing line for an initialization time. The second switch SW2 applies a voltage of the sensing line in which driving characteristics of pixels have been reflected (i.e., a voltage stored in CSIO) to a first node for a sampling time following the initialization time. The third switch SW3 applies the first reference voltage EVREF1 to a second node for the sampling time. One electrode of the sampling capacitor CSAM is connected to the first node and the other electrode thereof is connected to the second node. A sampling output that is the voltage of one electrode of the sampling capacitor CSAM increases from the initialization voltage VPRES for the sampling time.

Sampling outputs are simultaneously generated in the first to $240^{th}$ sampling circuits.

Each scaler includes a scaling capacitor CSLR connected to a third node and a fourth node, and a fourth switch SW4 connected to the third node and the fourth node. For a scaling time following the sampling time, the third node is connected to the first node through each sampling multiplexer SMUX, the fourth node is connected to the second node through each sampling multiplexer SMUX, and the second reference voltage EVREF2 is applied to the second node and the fourth node.

A scaling rate in each scaler for the scaling time is determined by the proportion of sampling capacitors CSAM to scaling capacitors CSLR. Voltages of the first and third nodes become scaling outputs for the scaling time. A scaling output may be "EVREF1+(VPRES+ΔV−EVREF1)*{CSAM/(CSAM+CSLR)}−ΔV'", as shown in FIG. 7. Here, ΔV' is EVREF1−EVREF2.

The global multiplexer GMUX includes a fifth switch SW5 for connecting the first scaler to the ADC, a sixth switch SW6 for connecting the second scaler to the ADC, a seventh switch SW7 for connecting the third scaler to the ADC, and an eighth switch SW8 for connecting the fourth scaler to the ADC. The fifth to eighth switches SW5 to SW8 are alternately turned on.

The first to fourth sampling multiplexers SMUX1 to SMUX4 are sequentially turned on. The first to fourth sampling multiplexers SMUX1 to SMUX4 are turned off in synchronization with on timings of the fifth to eighth switches SW5 to SW8. That is, while one of the first to fourth sampling multiplexers SMUX1 to SMUX4 is turned off, the three remaining sampling multiplexers are turned on.

For example, the second, third, and fourth sampling multiplexers SMUX2, SMUX3, and SMUX4 are turned on and the second to fourth scalers perform scaling operation while the first scaling output is toggled to the ADC through the fifth switch SW5. Subsequently, the first, third, and fourth sampling multiplexers SMUX1, SMUX3, and SMUX4 are turned on and the first, third, and fourth scalers perform scaling operation while the second scaling output is toggled to the ADC through the sixth switch SW6. Subsequently, the first, second, and fourth sampling multiplexers SMUX1, SMUX2, and SMUX4 are turned on and the first, second, and fourth scalers perform scaling operation while the third scaling output is toggled to the ADC through the seventh switch SW7. Subsequently, the first, second, and third sampling multiplexer SMUX1, SMUX2, and SMUX3 are turned on and the first, second, and third scalers perform scaling operation while the fourth scaling output is toggled to the ADC through the eighth switch SW8.

In this manner, the four scalers share scaling operation and toggling operation and simultaneously perform the scaling operation and the toggling operation while changing the scaling operation and the toggling operation at predetermined intervals in a ping-pong manner in the sensing circuit 22 according to the second embodiment. A longer scaling time can be set for the sensing circuit 22 in the second embodiment than in the first embodiment, and thus accuracy of scaling can be further improved.

Figure 10:
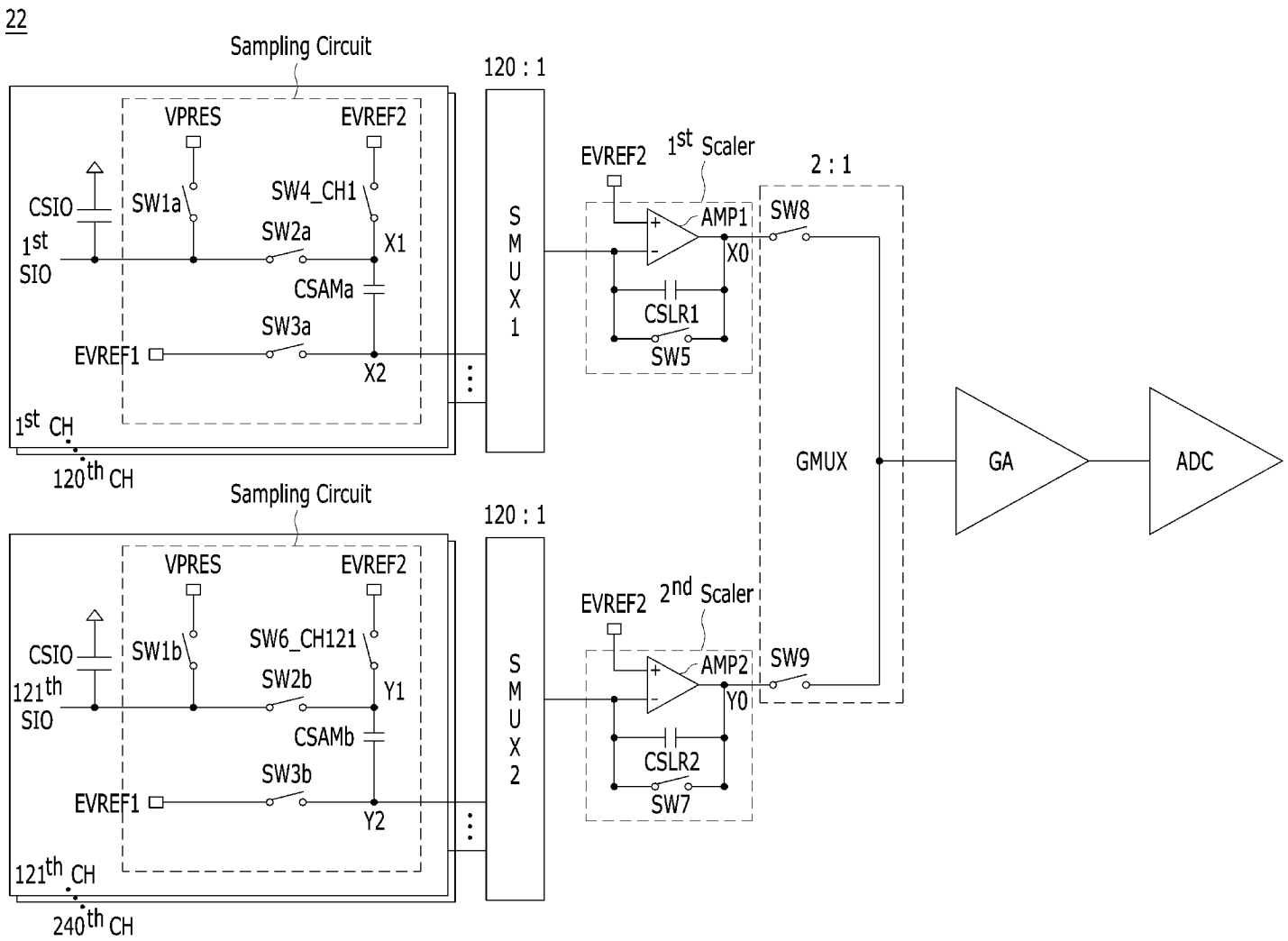
FIG. 10 is a diagram showing a third embodiment of the sensing circuit.
Figure 11:
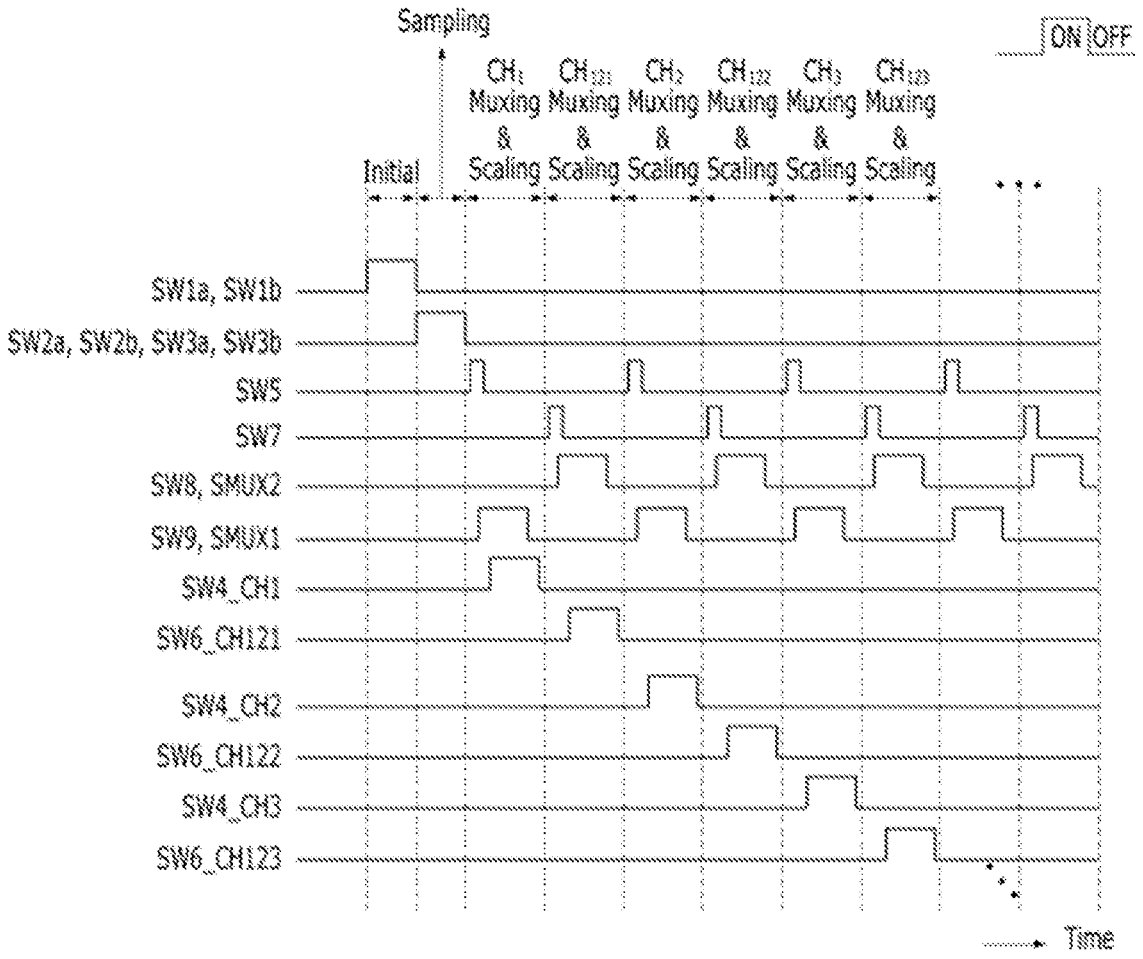
FIG. 11 is a diagram showing operation waveforms for the sensing circuit of FIG. 10 according to the third embodiment of the present disclosure.

FIG. 10 is a diagram showing a third embodiment of the sensing circuit and FIG. 11 is a diagram showing operation waveforms for the sensing circuit of FIG. 10 according to the third embodiment.

Referring to FIG. 10 and FIG. 11, the sensing circuit 22 includes first to $120^{th}$ sampling circuits connected to first to $120^{th}$ sensing channels SIO, a first sampling multiplexer SMUX1 for selectively connecting the first to $120^{th}$ sampling circuits to a first scaler, $121^{st}$ to $240^{th}$ sampling circuits connected to $121^{st}$ to $240^{th}$ sensing channels SIO, a second sampling multiplexer SMUX2 for selectively connecting the $121^{st}$ to $240^{th}$ sampling circuits to a second scaler, and a global multiplexer GMUX for selectively connecting outputs of the first and second scalers to an ADC.

The first sampling multiplexer SMUX1 and the second sampling multiplexer SMUX2 have an input-to-output ratio of 120:1. The global multiplexer GMUX has an input-to-output ratio of 2:1.

Each of the first to $120^{th}$ sampling circuits includes a first switch SW1*a*, a second switch SW2*a*, a third switch SW3*a*, a fourth switch SW4_CH1, and a sampling capacitor CSAMa. The first switch SW1*a* supplies the initialization voltage VPRES to a sensing line for an initialization time. The second switch SW2*a* applies a voltage of the sensing line in which driving characteristics of pixels have been reflected (i.e., a voltage stored in CSIO) to a first node X1 for a sampling time following the initialization time. The third switch SW3*a* applies the first reference voltage EVREF1 to a second node X2 for the sampling time. One electrode of the sampling capacitor CSAMa is connected to the first node X1 and the other electrode thereof is connected to the second node X2. A sampling output that is the voltage of one electrode of the sampling capacitor CSAMa increases from the initialization voltage VPRES for the sampling time. The fourth switch SW4_CH1 applies the second reference voltage EVREF2 to the first node X1 in a scaling time following the sampling time. Here, when the second node X2 is connected to the first scaler through the first sampling multiplexer SMUX1, the sampling output stored in the sampling capacitor CSAMa is transmitted to the first scaler.

Each of the $121^{st}$ to $240^{th}$ sampling circuits includes a first switch SW1*b*, a second switch SW2*b*, a third switch SW3*b*, a sixth switch SW6_CH121, and a sampling capacitor CSAMb. The first switch SW1*b* supplies the initialization voltage VPRES to a sensing line for the initialization time. The second switch SW2*b* applies a voltage of the sensing line in which driving characteristics of pixels have been reflected (i.e., a voltage stored in CSIO) to a first node Y1 for the sampling time following the initialization time. The third switch SW3*b* applies the first reference voltage EVREF1 to a second node Y2 for the sampling time. One electrode of the sampling capacitor CSAMb is connected to the first node Y1 and the other electrode thereof is connected to the second node Y2. A sampling output that is the voltage of one electrode of the sampling capacitor CSAMb increases from the initialization voltage VPRES for the sampling time. The sixth switch SW6_CH121 applies the second reference voltage EVREF2 to the first node Y1 in the scaling time following the sampling time. Here, when the second node Y2 is connected to the second scaler through the second sampling multiplexer SMUX2, the sampling output stored in the sampling capacitor CSAMb is transmitted to the second scaler.

Sampling outputs are simultaneously generated in the first to $240^{th}$ sampling circuits.

The first scaler includes an amplifier AMP1 having an inverting input terminal (−) connected to the second node X2 through the first sampling multiplexer SMUX1, a non-inverting input terminal (+) to which the second reference voltage EVREF2 is input, and an output terminal XO. The amplifier AMP1 improves the effect of settling to a target voltage within a short time such that a correct scaling voltage is generated within a limited scaling time. A scaling capacitor CSLR1 is connected between the inverting input terminal (−) and the output terminal XO of the amplifier AMP1. A voltage across the scaling capacitor CSLR1 changes according to charges flowing from the sampling capacitor CSAMa in the scaling time. At this time, a voltage applied to the output terminal XO of the amplifier AMP1 becomes a scaling voltage. A fifth switch SW5 is additionally connected between the inverting input terminal (−) and the output terminal XO of the amplifier AMP1. The fifth switch SW5 serves to reset the scaling capacitor CSLR1 prior to scaling operation in the scaling time.

The second scaler includes an amplifier AMP2 having an inverting input terminal (−) connected to the second node Y2 through the second sampling multiplexer SMUX2, a non-inverting input terminal (+) to which the second reference voltage EVREF2 is input, and an output terminal YO. The amplifier AMP1 improves the effect of settling to a target voltage within a short time such that a correct scaling voltage is generated within a limited scaling time. A scaling capacitor CSLR2 is connected between the inverting input terminal (−) and the output terminal XO of the amplifier AMP2. A voltage across the scaling capacitor CSLR2 changes according to charges flowing from the sampling capacitor CSAMb in the scaling time. At this time, a voltage applied to the output terminal YO of the amplifier AMP2 becomes a scaling voltage. A seventh switch SW7 is additionally connected between the inverting input terminal (−) and the output terminal YO of the amplifier AMP2. The seventh switch SW7 serves to reset the scaling capacitor CSLR2 prior to scaling operation in the scaling time.

The global multiplexer GMUX includes an eighth switch SW8 for connecting the first scaler to the ADC and a ninth switch SW9 for connecting the second scaler to the ADC. The eighth switch SW8 and the ninth SW9 are alternately turned on.

The first sampling multiplexer SMUX1 and the second sampling multiplexer SMUX2 are turned on/off in opposite phases. The first sampling multiplexer SMUX1 is turned off and the second sampling multiplexer SMUX2 is turned on while the eighth switch SW8 is turned on. The second sampling multiplexer SMUX2 is turned off and the first sampling multiplexer SMUX1 is turned on while the ninth switch SW9 is turned on.

In other words, the second sampling multiplexer SMUX2 is turned on and the second scaler performs scaling operation while the first scaling output is toggled to the ADC through the eighth switch SW8. Subsequently, the first sampling multiplexer SMUX1 is turned on and the first scaler performs scaling operation while the second scaling output is toggled to the ADC through the ninth switch SW9.

Specifically, scaling operation is performed on the first sensing channel in the first scaler. Subsequently, scaling operation is performed on the $121^{st}$ sensing channel in the second scaler while scaling output 1 of the first scaler is toggled to the ADC. Subsequently, scaling operation is performed on the second sensing channel in the first scaler while scaling output 121 of the second scaler is toggled to the ADC. Subsequently, scaling operation is performed on the $122^{nd}$ sensing channel in the second scaler while scaling output 2 of the first scaler is toggled to the ADC. Subsequently, scaling operation is performed on the third sensing channel in the first scaler while scaling output 122 of the second scaler is toggled to the ADC. Subsequently, scaling operation is performed on the $123^{rd}$ sensing channel in the second scaler while scaling output 3 of the first scaler is toggled to the ADC. Subsequently, scaling operation is performed on the fourth sensing channel in the first scaler while scaling output 123 of the second scaler is toggled to the ADC.

In this manner, the two scalers respectively perform scaling operation and toggling operation at the same time while changing the scaling operation and the toggling operation at predetermined intervals in a ping-pong manner in the sensing circuit 22 according to the third embodiment.

Figure 12A:
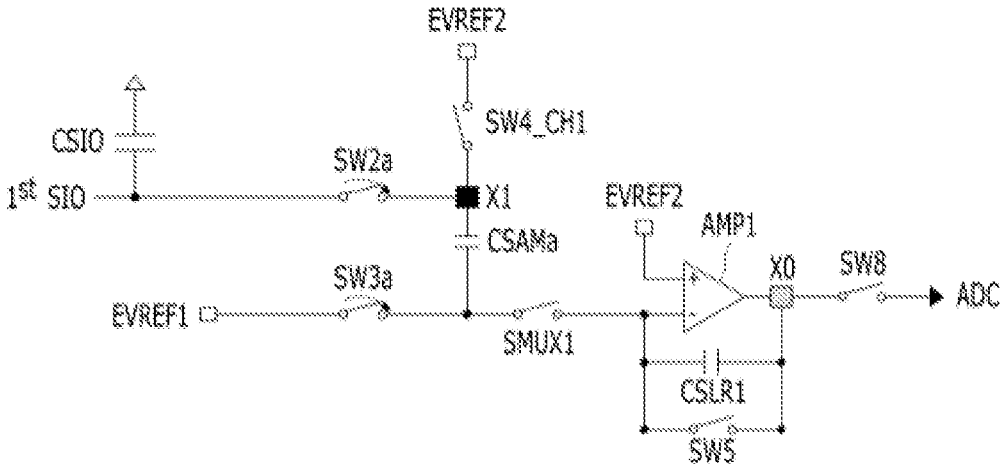
FIG. 12A, FIGS. 12B, and 12C are diagrams showing operation states of the sensing circuit of FIG. 10 corresponding to a sampling period, a reset period, and a multiplexing & scaling period according to one embodiment of the present disclosure.
Figure 12B:
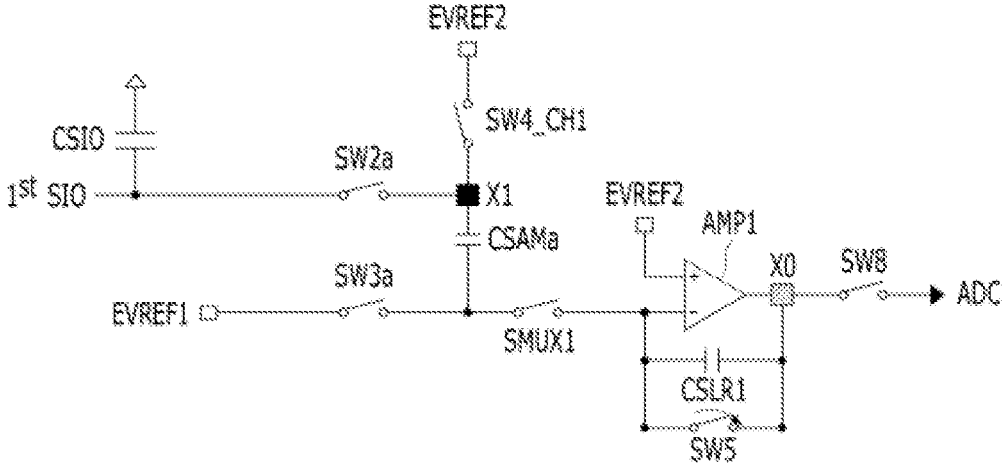
Figure 12C:
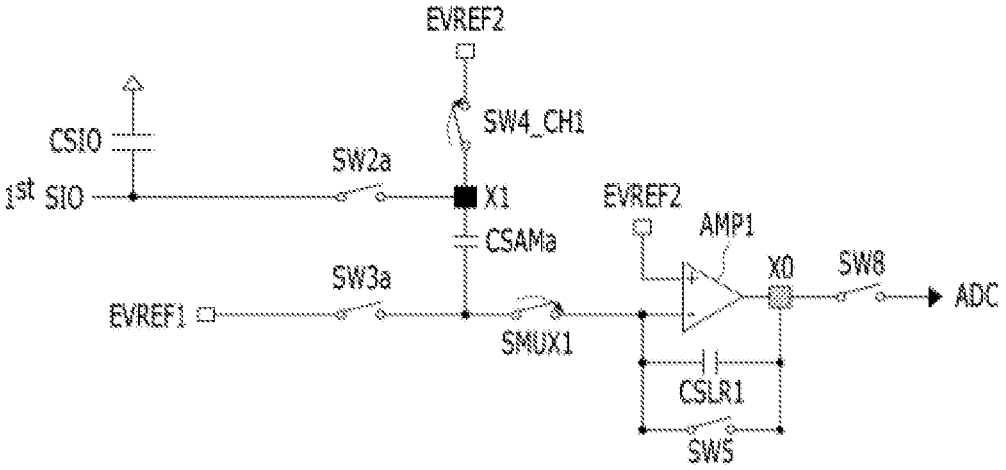
Figure 13:
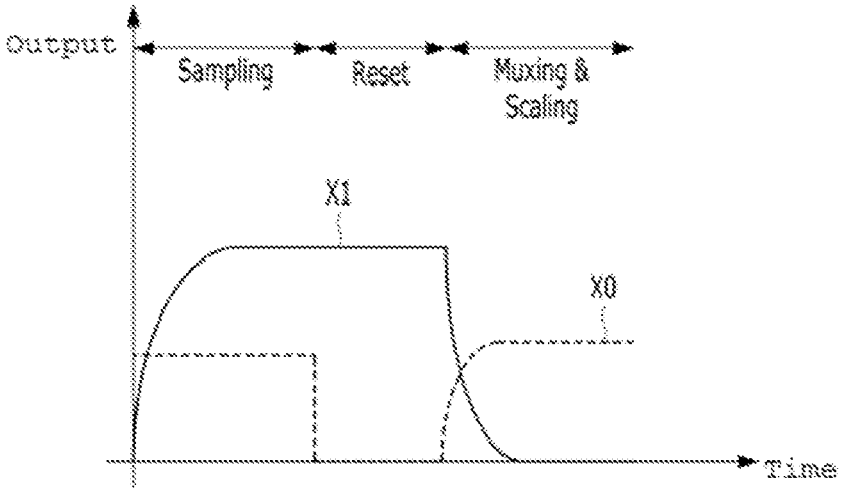
FIG. 13 is a diagram showing node voltage change in the sensing circuit of FIG. 10 in the sampling period, the reset period, and the multiplexing & scaling period; according to one embodiment of the present disclosure

FIG. 12A, FIGS. 12B, and 12C are diagrams showing operation states of the sensing circuit of FIG. 10 corresponding to a sampling period, a reset period, and a multiplexing & scaling period. FIG. 13 is a diagram showing node voltage change in the sensing circuit of FIG. 10 in the sampling period, the reset period, and the multiplexing & scaling period.

Referring to FIG. 12A, the second switch SW2*a* and the third switch SW3*a* are turned on and a voltage of the first sensing channel in which driving characteristics of pixels have been reflected (i.e., a voltage stored in CSIO) is stored in the sampling capacitor CSAMa in the sampling period.

Referring to FIG. 12B, the fifth switch SW5 of the first scaler is turned on to reset the scaling capacitor CSLR1 of the first scaler in the reset period.

Referring to FIG. 12C, the fourth switch SW4_CH1 and the first sampling multiplexer SMUX1 are turned to cause charges stored in the sampling capacitor CSAMa to move to the scaling capacitor CSLR1, and thus scaling operation is performed on the first sensing channel in the first scaler in the multiplexing & scaling period.

As shown in FIG. 13, relative sizes of a sampling output charged at X1 and a scaling output charge at X0 are determined by a capacity ratio of the sampling capacitor CSAM to the scaling capacitor CSLR.

Figure 14:
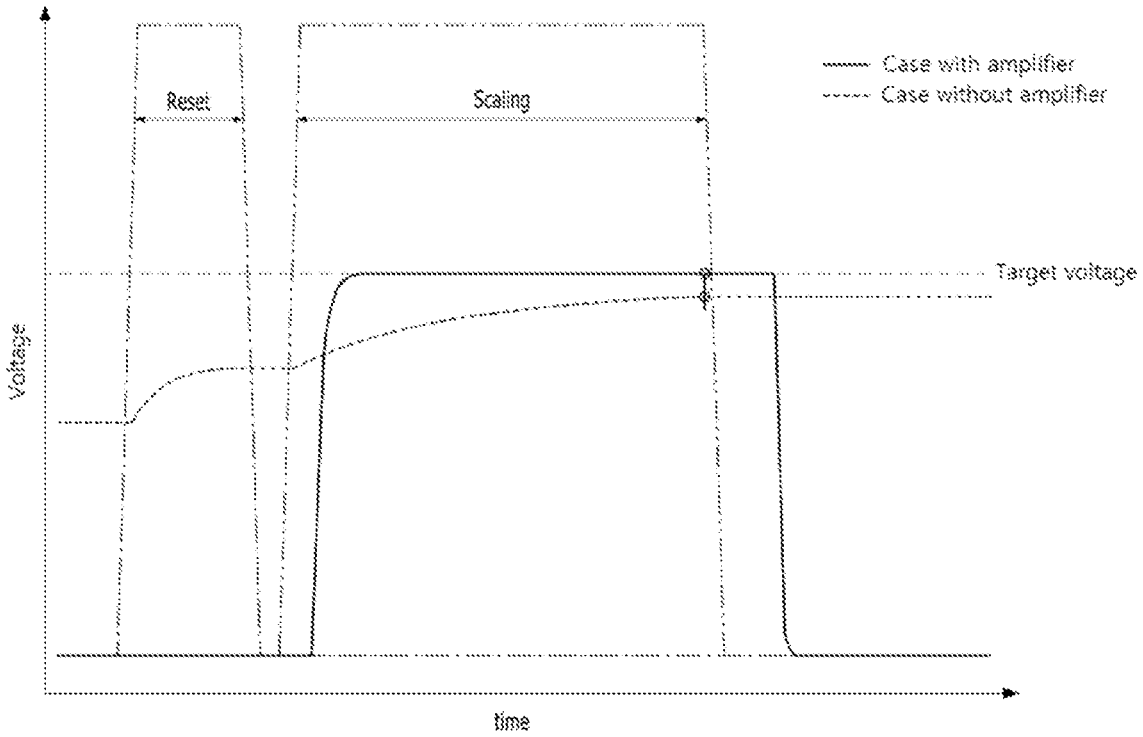
FIG. 14 is simulation results showing the effects when amplifiers are added to scalers.

FIG. 14 is simulation results showing the effects when amplifiers are added to scalers.

Referring to FIG. 14, when amplifiers are added to scalers as in the above-described third embodiment, a time taken to reach a target voltage during scaling operation decreases and accuracy of settling is improved as compared to cases in which amplifiers are not added to the scalers.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

According to the electroluminescent display device according to embodiments of the present disclosure, a MUX-scaler-MUX connection structure is realized in a sensing circuit and thus the number of scalers is reduced to be less than the number of sampling circuits, decreasing the size and manufacturing cost of the sensing circuit.

According to the electroluminescent display device according to embodiments of the present disclosure, a plurality of scalers simultaneously perform scaling operation and toggling operation in a sharing manner while changing the scaling operation and toggling operation at predetermined intervals in a ping-pong manner. Accordingly, scaling time can be secured and scaling accuracy can be improved.

According to the electroluminescent display device according to embodiments of the present disclosure, a time taken to reach a target voltage during scaling operation decreases and accuracy of settling is improved because amplifiers are added to scalers.

Effects which may be obtained by the present disclosure are not limited to the above-described effects, and various other effects may be evidently understood by those skilled in the art to which the present disclosure pertains from the following description.

What is claimed is:

1. An electroluminescent display device, comprising:

a display panel including a plurality of pixels connected to a plurality of sensing lines;

a plurality of sampling circuits configured to simultaneously sample driving characteristics of the plurality of pixels to generate sampling outputs;

a plurality of sampling multiplexers configured to divide the sampling outputs into a plurality of groups of sampling outputs and to alternately select the plurality of groups of sampling outputs;

a plurality of scalers, each of the plurality of scalers connected to a corresponding one of the plurality of sampling multiplexers; and a global multiplexer configured to selectively connect outputs of the plurality of scalers to an analog-to-digital conversion circuit, wherein while a first scaler among the plurality of scalers is connected to the analog-to-digital conversion circuit, each remaining scaler from the plurality of scalers is not connected to the analog-to-digital conversion circuit and is connected to one of the plurality of sampling circuits through one of the plurality of sampling multiplexers.

2. The electroluminescent display device according to claim 1, wherein a total number of the plurality of scalers is less than a total number of plurality of sampling circuits.

3. The electroluminescent display device according to claim 1, wherein the plurality of scalers includes the first scaler and a second scaler, and the plurality of sampling multiplexors including a first sampling multiplexor and a second sampling multiplexor, wherein the second scaler scales any one of sampling outputs in a second group selected through the second sampling multiplexer while the first scaler is connected to the analog-to-digital conversion circuit, and the first scaler scales any one sampling output in a first group selected through the first sampling multiplexer while the second scaler is connected to the analog-to-digital conversion circuit.

4. The electroluminescent display device according to claim 1, wherein each of the plurality of sampling circuits includes:

a first switch configured to supply an initialization voltage to a sensing line among the plurality of sensing lines for an initialization time;

a second switch configured to apply a voltage of the sensing line on which the driving characteristics of the pixels is reflected to a first node for a sampling time that is subsequent the initialization time;

a third switch configured to apply a first reference voltage to a second node during the sampling time; and a sampling capacitor connected to the first node and the second node.

5. The electroluminescent display device according to claim 4, wherein each of the plurality of scalers includes:

a scaling capacitor connected to a third node and a fourth node; and a fourth switch connected to the third node and the fourth node, wherein the third node is connected to the first node through a corresponding sampling multiplexer that is connected to the scalar, the fourth node is connected to the second node through the corresponding sampling multiplexer, and a second reference voltage different from the first reference voltage is applied to the second node and the fourth node for a scaling time that is subsequent to the sampling time.

6. The electroluminescent display device according to claim 5, wherein the first reference voltage is greater than the second reference voltage.

7. The electroluminescent display device according to claim 1, wherein each of the plurality of sampling circuits includes:

a first switch configured to supply an initialization voltage to a sensing line among the plurality of sensing lines for an initialization time;

a second switch configured to apply a voltage of the sensing line on which the driving characteristics of the pixels is reflected to a first node for a sampling time that is subsequent the initialization time;

a third switch configured to apply a first reference voltage to a second node for the sampling time;

a sampling capacitor connected to the first node and the second node; and a fourth switch configured to apply a second reference voltage different from the first reference voltage to the first node in a scaling time that is subsequent the sampling time, wherein the second reference voltage is applied to the second node through a corresponding sampling multiplexer from the plurality of sampling multiplexers during the scaling time.

8. The electroluminescent display device according to claim 7, wherein each of the plurality of scalers includes:

an amplifier having an inverting input terminal connected to the second node through the corresponding sampling multiplexer, a non-inverting input terminal configured to receive the second reference voltage, and an output terminal;

a scaling capacitor connected between the inverting input terminal and the output terminal of the amplifier; and a fifth switch connected between the inverting input terminal and the output terminal of the amplifier.

9. An electroluminescent display device comprising:

a display panel including a plurality of pixels connected to a plurality of sensing lines;

a plurality of sampling circuit groups including a first sampling circuit group comprising a first plurality of sampling circuits that are each connected to a corresponding one of the plurality of sensing lines, and a second sampling circuit group including a second plurality of sampling circuits that are each connected to a corresponding one of the plurality of sensing lines, the plurality of sampling circuit groups configured to sample driving characteristics of the plurality of pixels;

a plurality of sampling multiplexers including a first sampling multiplexer and a second sampling multiplexer, the first sampling multiplexer connected to the first sampling circuit group but not the second sampling circuit group, and the second sampling multiplexer connected to the second sampling circuit group but not the first sampling circuit group;

a plurality of scalers including a first scaler and a second scaler, the first scaler connected to the first sampling multiplexer but not the second sampling multiplexer, and the second scaler connected to the second sampling multiplexer but not the first sampling multiplexer;

a global multiplexer connected to a first output of the first scaler and to a second output of the second scalar, the global multiplexor configured to selectively connect the first output of the first scalar or the second output of the second scalar to an analog-to digital conversion circuit (ADC), wherein the first scaler is not connected to the first sampling circuit group while the first output of the first scalar is connected to the ADC, and the second scaler is not connected to the second sampling circuit group while the second output of the second scaler is connected to the ADC.

10. The electroluminescent display device of claim 9, wherein while the first output of the first scalar is connected to the ADC through the global multiplexor, the second output of the second scalar is not connected to the ADC and the second input of the second scalar is connected to the second sampling circuit group through the second sampling multiplexor, and while the second output of the second scalar is connected to the ADC through the global multiplexor, the first output of the first scalar is not connected to the ADC and the first input of the first scalar is connected to the first sampling circuit group through the first sampling multiplexor.

11. The electroluminescent display device of claim 9, wherein a total number of the first plurality of sampling circuits and the second plurality of sampling circuits is greater than a total number of the plurality of scalars.

12. The electroluminescent display device of claim 9, wherein a total number of the plurality of sampling multiplexers is equal to a total number of the plurality of scalers.

13. The electroluminescent display device of claim 9, wherein at least one of the plurality of sampling circuits comprises:

a first switch configured to supply during an initialization time an initialization voltage to a sensing line from the plurality of sensing lines;

a second switch configured to apply to a first node the initialization voltage during the initialization time, and configured to apply to the first node a voltage of the sensing line that is representative of driving characteristics of a pixel connected to the sensing line during a sampling time that is subsequent the initialization time;

a third switch configured to apply to a second node a first reference voltage during the initialization time and the sampling time; and a sampling capacitor connected to the first node and the second node.

14. The electroluminescent display device of claim 13, wherein at least one of the plurality of scalar circuits comprises:

a scaling capacitor connected to a third node and a fourth node; and a fourth switch connected to the third node and the fourth node, wherein the third node is connected to the first node through a corresponding sampling multiplexer that is connected to the at least one scalar, and the fourth node is connected to the second node through the corresponding sampling multiplexer, and wherein a second reference voltage that is different from the first reference voltage is applied to the second node and the fourth node for a scaling time that is subsequent to the sampling time.

15. The electroluminescent display device according to claim 14, wherein the first reference voltage is greater than the second reference voltage.

16. The electroluminescent display device according to claim 9, wherein at least one of the plurality of sampling circuits includes:

a first switch configured to supply an initialization voltage to a sensing line among the plurality of sensing lines for an initialization time;

a second switch configured to apply the initialization voltage to a first node during the initialization time, and configured to apply a voltage of the sensing line that is representative of driving characteristics of a pixel connected to the sensing line during a sampling time that is subsequent the initialization time;

a third switch configured to apply to a second node a first reference voltage during the sampling time;

a sampling capacitor connected to the first node and the second node; and a fourth switch configured to apply to the first node a second reference voltage that is different from the first reference voltage during a scaling time that is subsequent the sampling time, wherein the second reference voltage is applied to the second node through a corresponding sampling multiplexer from the plurality of sampling multiplexers during the scaling time.

17. The electroluminescent display device according to claim 16, wherein at least one of the plurality of scalers includes:

an amplifier comprising an inverting input terminal, a non-inverting input terminal, and an output terminal, the inverting terminal connected to the second node through the corresponding sampling multiplexer, and the non-inverting input terminal configured to receive the second reference voltage;

a scaling capacitor connected between the inverting input terminal and the output terminal of the amplifier; and a fifth switch connected between the inverting input terminal and the output terminal of the amplifier.

* * * * *